US010191435B2

(12) United States Patent
Terada

(10) Patent No.: US 10,191,435 B2
(45) Date of Patent: Jan. 29, 2019

(54) IMAGE FORMING SYSTEM AND CONTROL PROGRAMS FOR EXECUTING IMAGE FORMATION AND IDENTIFYING ERRORS

(71) Applicant: Konica Minolta, Inc., Tokyo (JP)

(72) Inventor: Kenji Terada, Tokyo (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 15/698,441

(22) Filed: Sep. 7, 2017

(65) Prior Publication Data

US 2018/0067437 A1 Mar. 8, 2018

(30) Foreign Application Priority Data

Sep. 8, 2016 (JP) ..... 2016-175767

(51) Int. Cl.
*G03G 15/00* (2006.01)

(52) U.S. Cl.
CPC ..... *G03G 15/70* (2013.01); *G03G 15/5016* (2013.01); *G03G 15/5062* (2013.01); *G03G 15/55* (2013.01); *B65H 2601/251* (2013.01); *G03G 15/502* (2013.01); *G03G 2215/00067* (2013.01); *G03G 2215/00548* (2013.01); *G03G 2215/00679* (2013.01); *G03G 2215/00708* (2013.01)

(58) Field of Classification Search
CPC ..... G03G 15/502; G03G 15/5062; G03G 15/5016; G03G 15/55; G03G 15/70; G03G 21/1695; G03G 2215/00679; G03G 2215/00708; G03G 2215/00548; G03G 2215/00569; G03G 2221/1672
USPC ..... 399/11, 15, 16
See application file for complete search history.

(56) References Cited

U.S. PATENT DOCUMENTS

| | | | | |
|---|---|---|---|---|
| 9,389,566 | B2 * | 7/2016 | Takahashi | G03G 15/5062 |
| 2011/0002702 | A1 * | 1/2011 | Niijima | G03G 15/50 399/44 |
| 2011/0299862 | A1 * | 12/2011 | Kozuka | G03G 15/70 399/19 |
| 2012/0286042 | A1 * | 11/2012 | Sawano | G03G 15/5062 235/437 |
| 2013/0155422 | A1 * | 6/2013 | Kuo | H04N 1/506 358/1.2 |
| 2015/0192884 | A1 * | 7/2015 | Sone | G03G 15/50 399/49 |
| 2017/0219979 | A1 * | 8/2017 | Arimoto | G03G 15/01 |

FOREIGN PATENT DOCUMENTS

| | | | |
|---|---|---|---|
| JP | 2005125633 A | * | 5/2005 |
| JP | 2009-051618 A | | 3/2009 |

* cited by examiner

*Primary Examiner* — Robert B Beatty
(74) *Attorney, Agent, or Firm* — Baker & Hostetler LLP

(57) ABSTRACT

An image forming apparatus includes: an image formation part that forms an image on a paper sheet; a conveyor that includes a plurality of conveying members and conveys the paper sheet; a hardware processor that acquires information on a smudge on a paper sheet on which an image has been formed by the image formation part, and identifies, from the plurality of conveying members, one or more dirty conveying member(s) that may have caused the smudge based on at least one of the information on the smudge, information on the conveying members, and information on a job for image formation executed by the image formation part.

19 Claims, 12 Drawing Sheets

IMAGE FORMING SYSTEM AND CONTROL PROGRAMS FOR EXECUTING IMAGE FORMATION AND IDENTIFYING ERRORS

Japanese Patent Application No. 2016-175767 filed on Sep. 8, 2016, including description, claims, drawings, and abstract the entire disclosure, is incorporated herein by reference in its entirety.

BACKGROUND

Technological Field

The present invention relates to an art in an image forming system and a control program for image formation that surely identifies a dirty roller or rollers (a roller or rollers with toner) that has/have caused a smudge on a paper sheet.

Description of the Related Art

Electrophotographic image forming apparatuses are used for forming an image on a paper sheet by transferring a toner image, which corresponds to a data image, to the paper sheet in various apparatuses such as printers and coping machines. In such an electrophotographic image forming apparatus, after a toner image is transferred to a paper sheet, the paper sheet is subjected to heat and pressure to fix the toner image on the paper sheet.

When a paper sheet with unfixed toner is conveyed, the toner on the paper sheet may adhere to a conveying roller. In another case, when a user cleans a paper jam by removing a jammed paper sheet with unfixed toner from an apparatus, the toner on the jammed paper sheet may adhere to a conveying roller. In yet another case, unfixed toner may repeatedly migrate between a paper sheet and conveying rollers or even fixed toner may adhere to a conveying roller.

When the amount of toner on a conveying roller exceeds a certain amount, some toner is transferred from the conveying roller to a paper sheet being conveyed, which causes a smudge (streak) on the paper sheet.

Since an image forming apparatus includes many rollers on its conveyance paths, it is difficult to identify a dirty roller that has caused the smudge on the paper sheet. To clean the dirty roller, a user has to check every roller, which takes a lot of time and effort. JP 2009-51618 A discloses a related art.

JP 2009-51618 A discloses an image forming apparatus in which conveying rollers are disposed at different positions in the paper width direction and a sensor is disposed on a conveyance path for detecting a smudge to identify a dirty conveying roller based on the position of the smudge.

In the art of JP 2009-51618 A, a detector detects a smudge at a different position from that of the dirty roller to identify the dirty roller.

In the art of JP 2009-51618 A, there is a problem that an image forming system having many branched conveyance paths requires sensors to be disposed on every conveyance path for detecting a smudge. In addition, since the intervals between the rollers are different, it is difficult to perform conveyance control when a large-sized paper sheet is conveyed in a small interval between rollers.

SUMMARY

The present invention has been made to solve the above problems, and an object thereof is to provide an image forming system and a control program for image formation.

To achieve the abovementioned object, according to an aspect of the present invention, an image forming apparatus reflecting one aspect of the present invention comprises: an image formation part that forms an image on a paper sheet; a conveyor that includes a plurality of conveying members and conveys the paper sheet; a hardware processor that acquires information on a smudge on a paper sheet on which an image has been formed by the image formation part, and identifies, from the plurality of conveying members, one or more dirty conveying member(s) that may have caused the smudge based on at least one of the information on the smudge, information on the conveying members, and information on a job for image formation executed by the image formation part.

BRIEF DESCRIPTION OF THE DRAWING

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described in detail with reference to the drawings. However, the scope of the invention is not limited to the disclosed embodiments.

[General Structure]

Figure 1:
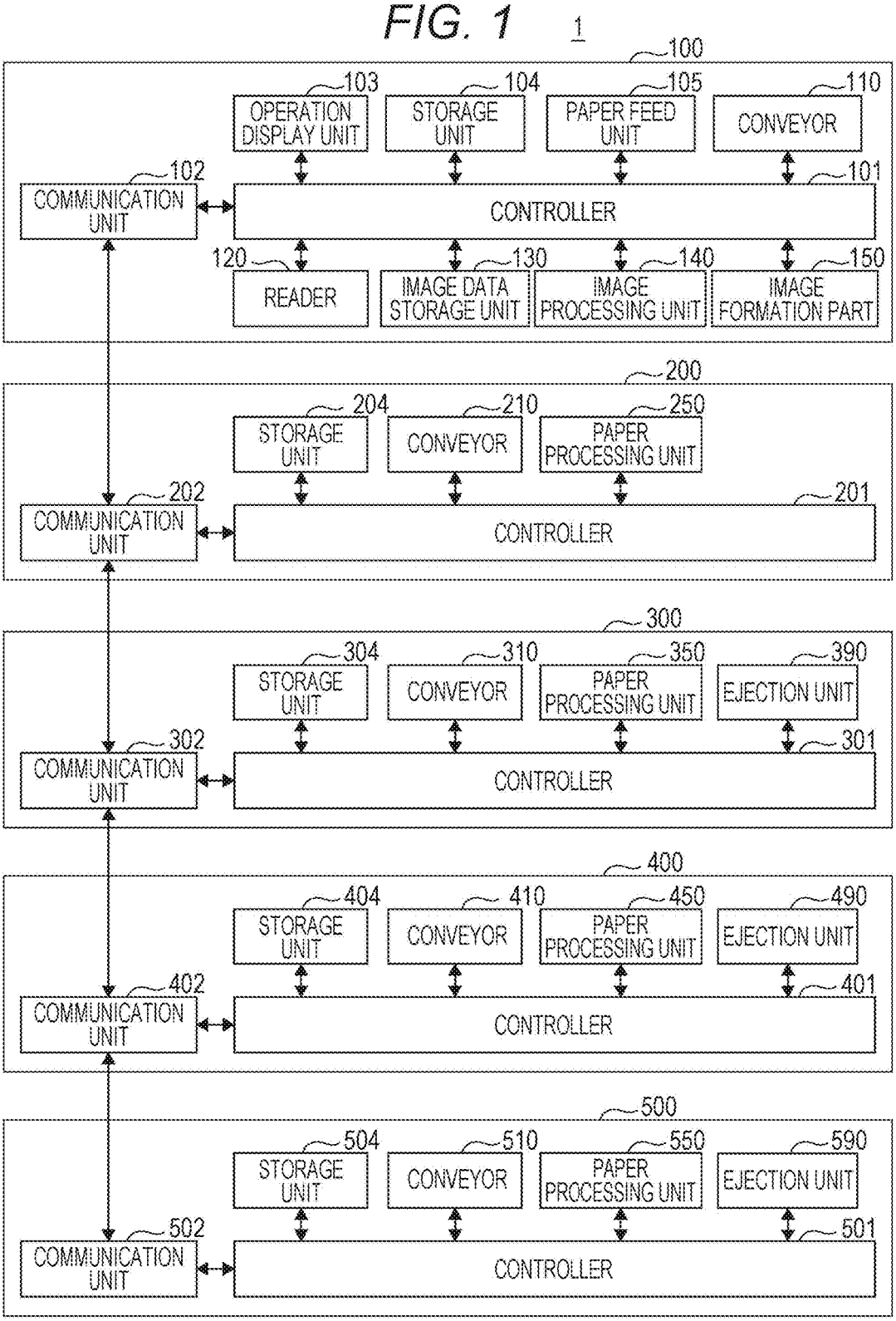
FIG. 1 is a block diagram of an image forming system according to an embodiment of the present invention.

With reference to FIG. 1, an image forming apparatus of an embodiment of the present invention and an image forming system including the image forming apparatus and post-processing apparatuses will now be described. Although not shown, an image-formation controlling apparatus that controls the characteristic elements of this embodiment may be provided outside of the image forming apparatus or the image forming system.

Figure 2:
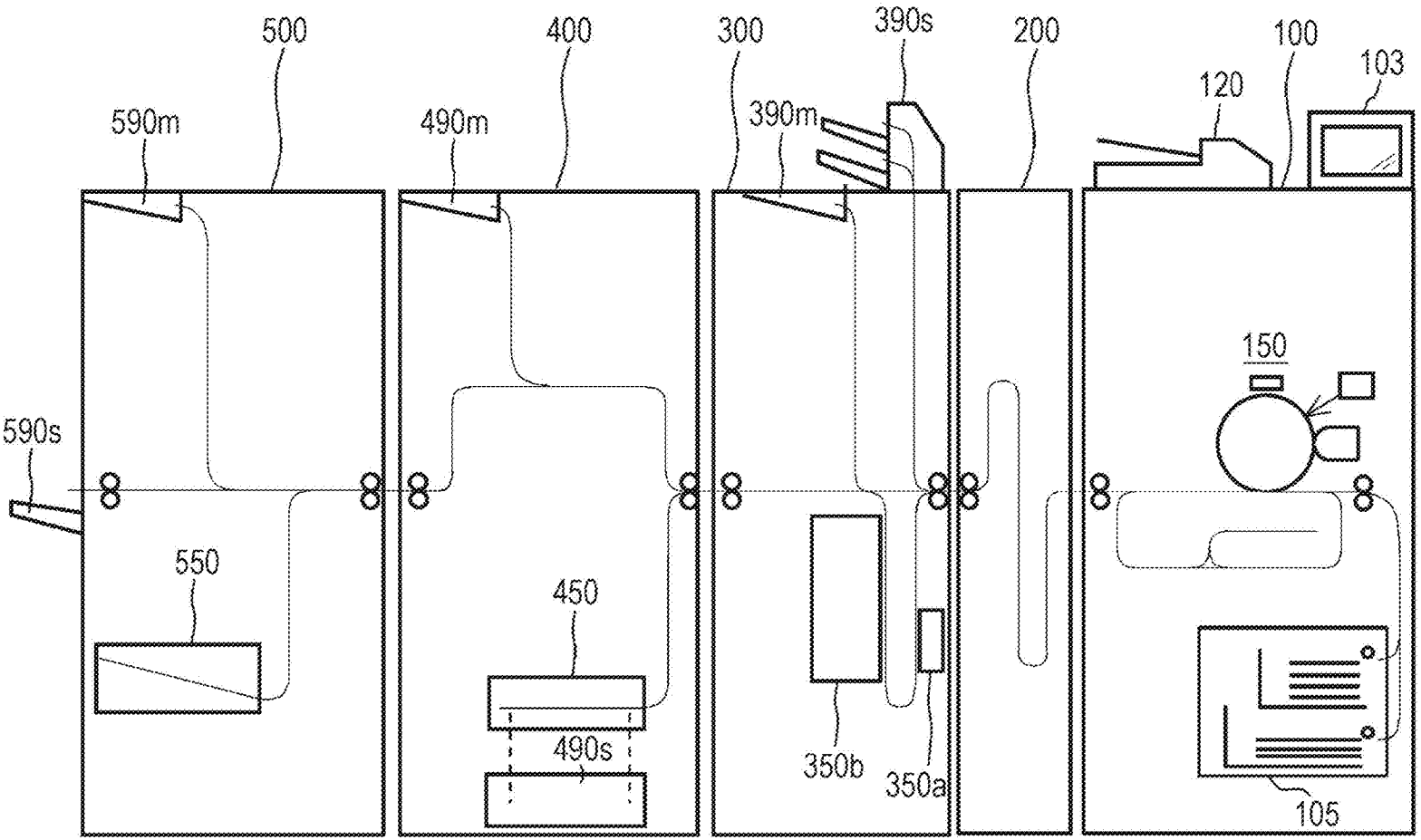
FIG. 2 is a schematic diagram of an image forming system according to an embodiment of the present invention.

FIG. 1 shows the structural elements of the image forming apparatus and the image forming system based on their functions. FIG. 2 schematically shows the units of the image forming apparatus and the image forming system in a cross-sectional view to show how a paper sheet is conveyed inside the apparatus and the system.

As shown in FIGS. 1 and 2, this image forming system 1 includes an image forming apparatus 100, a post-processing apparatus 200, a post-processing apparatus 300, a post-processing apparatus 400, and a post-processing apparatus 500. These apparatuses are arranged in this order in the paper conveying direction. It should be noted that these apparatuses may be arranged in other ways in the image forming system 1.

The image forming apparatus 100 includes a controller 101, a communication unit 102, an operation display unit 103, a storage unit 104, a paper feed unit 105, a conveyor 110, a reader 120, an image data storage unit 130, an image processing unit 140, and an image formation part 150.

The controller 101 includes a central processing unit (CPU), and memories such as a read only memory (ROM) and a random access memory (RAM). The controller 101 reads control programs from the ROM and the storage unit 104 and expands the programs in the RAM to execute them for controlling the other units. The post-processing apparatuses 200 to 500 also include respective controllers 201 to 501 that function as in the controller 101.

The controller 101 controls not only the individual units of the image forming apparatus 100 but also the whole image forming system including the image forming apparatus 100 and the post-processing apparatuses. The controller 101 selects some potentially dirty rollers that may have caused a smudge on a paper sheet and narrows down the potentially dirty rollers to identify a dirty roller or rollers. The communication unit 102 communicates with other apparatuses connected to the image forming apparatus. The operation display unit 103 sends operational input signals in response to operational data entry by an operator to the controller 101 and displays an operational status of the image forming apparatus 100. The storage unit 104 stores the control programs and other setting data and functions as a work area for executing the control programs. The paper feed unit 105 feeds the paper sheets stored in the unit. The conveyor 110 conveys a paper sheet fed to be subjected to image formation at a predetermined speed. The reader 120 scans an original to generate image data. The image data storage unit 130 stores image data for image formation and other data. The image processing unit 140 performs various image processing procedures necessary for image formation. The image formation part 150 prints (forms) an image on a paper sheet based on the instructions on image formation and the processed image data.

The post-processing apparatus 200 is connected to the image forming apparatus 100, and includes a controller 201, a communication unit 202, a storage unit 204, a conveyor 210, and a paper processing unit 250. The controller 201 controls the individual units of the post-processing apparatus 200. The communication unit 202 communicates with the image forming apparatus 100. The storage unit 204 stores the control programs and other setting data and functions as a work area for executing the control programs. The conveyor 210 conveys a paper sheet at a predetermined speed. The paper processing unit 250 performs various post-processing procedures on a paper sheet being conveyed.

The post-processing apparatus 300 is connected to the post-processing apparatus 200, and includes a controller 301, a communication unit 302, a storage unit 304, a conveyor 310, a paper processing unit 350, and an ejection unit 390. The ejection unit 390 includes a main ejection port 390*m* and a secondary ejection port 390*s*. The controller 301 controls the individual units of the post-processing apparatus 300. The communication unit 302 communicates with the image forming apparatus 100 and other apparatuses. The storage unit 304 stores the control programs and other setting data and functions as a work area for executing the control programs. The conveyor 310 conveys a paper sheet at a predetermined speed. The paper processing unit 350 performs various post-processing procedures on a paper sheet being conveyed. The ejection unit 390 ejects a paper sheet from the main ejection port 390*m* or the secondary ejection port 390*s* to the outside of the apparatus.

The post-processing apparatus 400 is connected to the post-processing apparatus 300, and includes a controller 401, a communication unit 402, a storage unit 404, a conveyor 410, a paper processing unit 450, and an ejection unit 490. The ejection unit 490 includes a main ejection port 490*m* and a secondary ejection port 490*s*. The controller 401 controls the individual units of the post-processing apparatus 400. The communication unit 402 communicates with the image forming apparatus 100 and other apparatuses. The storage unit 404 stores the control programs and other setting data and functions as a work area for executing the control programs. The conveyor 410 conveys a paper sheet at a predetermined speed. The paper processing unit 450 performs various post-processing procedures on a paper sheet being conveyed. The ejection unit 490 ejects a paper sheet from the main ejection port 490*m* or the secondary ejection port 490*s* to the outside of the apparatus.

The post-processing apparatus 500 is connected to the post-processing apparatus 400, and includes a controller 501, a communication unit 502, a storage unit 504, a conveyor 510, a paper processing unit 550, and an ejection unit 590. The ejection unit 590 includes a main ejection port 590*m* and a secondary ejection port 590*s*. The controller 501 controls the individual units of the post-processing apparatus 500. The communication unit 502 communicates with the image forming apparatus 100 and other apparatuses. The storage unit 504 stores the control programs and other setting data and functions as a work area for executing the control programs. The conveyor 510 conveys a paper sheet at a predetermined speed. The ejection unit 590 ejects a paper sheet from the main ejection port 590*m* or the secondary ejection port 590*s* to the outside of the apparatus.

It should be noted that the structural elements of the image forming apparatus 100 and the post-processing apparatuses 200 to 500 and their functions are not limited to the above.

[Operation]

With reference to the flow chart of FIG. 3, the explanatory diagrams of screen statuses of FIGS. 4 to 6, the explanatory diagram of an operational status of FIG. 7, the flow chart of FIG. 8, and the explanatory diagrams of operational statuses of FIGS. 9 to 12, the image forming system and the control program for image formation of an embodiment of the present invention will now be described following the operational procedures.

Figure 3:
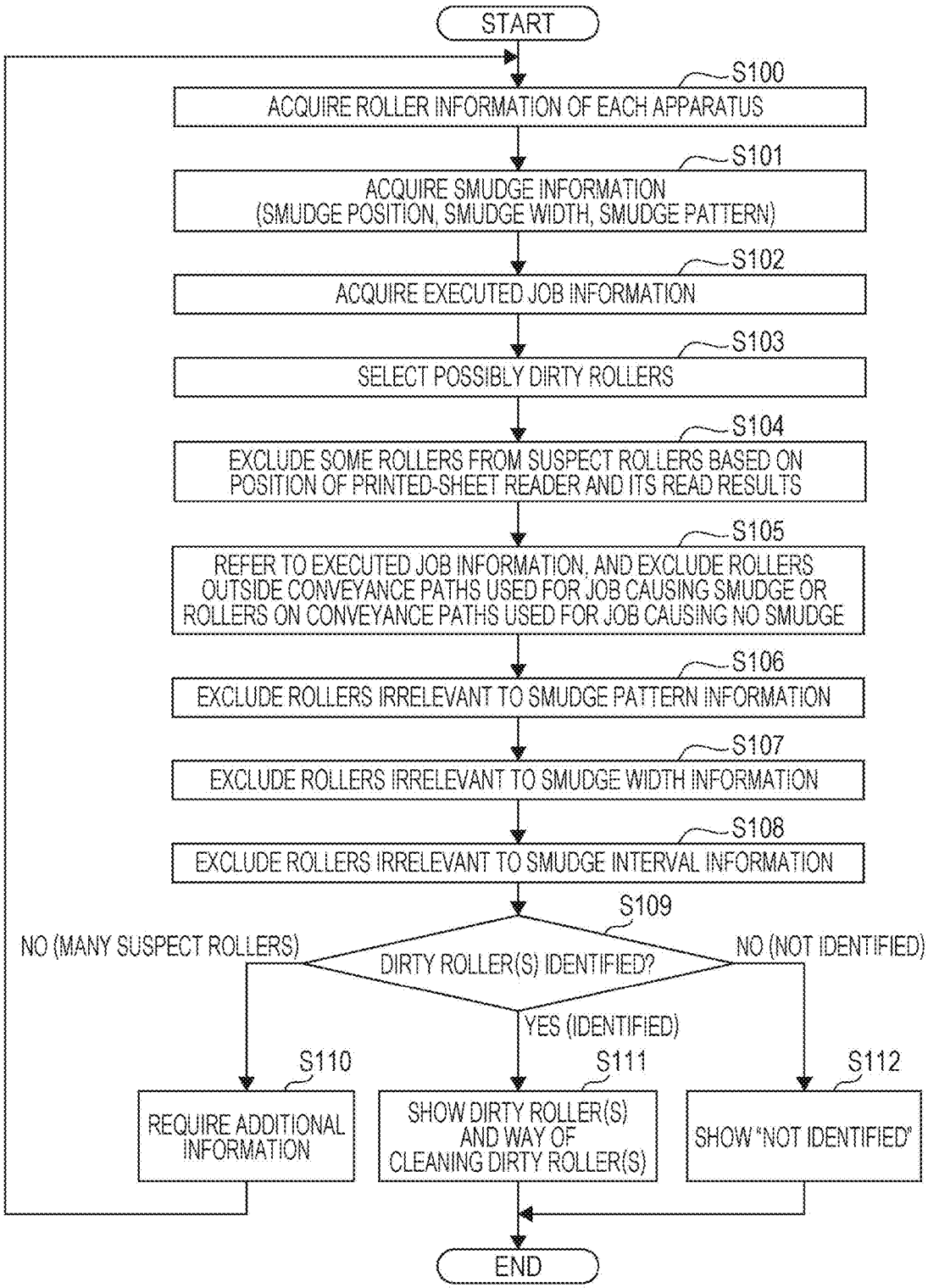
FIG. 3 is a flow chart of the operational steps for identifying a dirty roller or rollers according to an embodiment of the present invention.

When a user finds a smudge on a paper sheet that has undergone image formation by the image forming system 1 and clicks a tab for identifying a dirty roller or rollers that has/have caused the smudge on the paper sheet, on the screen of the operation display unit 103, the controller 101 starts operation following the flow chart of FIG. 3. Alternatively, when the user calls a customer support center and an operator in the customer support center remotely controls the controller 101, the controller 101 also starts operation following the flow chart of FIG. 3. Alternatively, when a printed-sheet reader (not shown) detects a smudge on a paper sheet, the controller 101 also starts operation following the flow chart of FIG. 3.

In the image forming system 1, the storage unit of each apparatus (the storage unit 104 of the image forming apparatus 100, the storage unit 204 of the post-processing apparatus 200, the storage unit 304 of the post-processing apparatus 300, the storage unit 404 of the post-processing apparatus 400, and the storage unit 504 of the post-processing apparatus 500) stores information on the rollers of the apparatus including information on the positions of the rollers (in the main scanning direction), information on the widths of the rollers, information on the intervals between the pairs of rollers (when a plurality of pairs of rollers are provided), and information on the tread patterns (surface patterns) of the rollers. The controller 101 retrieves the information on the rollers of each apparatus and collectively stores the information in the storage unit 104 (step S100 in FIG. 3). The controller 101 may retrieve and store the information on the rollers of each apparatus when the image forming system 1 is turned on. Alternatively, the controller 101 may acquire the information on the rollers when a new apparatus is connected to the image forming system 1 and the information on the connection is generated.

The controller 101 acquires information on the smudge on the paper sheet with the image (step S101 in FIG. 3). The information on the smudge includes at least one of information on the position of the smudge on the paper sheet, information on the width of the smudge, information on the interval(s) between the smudges (when a plurality of smudges are found), and information on the pattern of the smudge.

Figure 4:
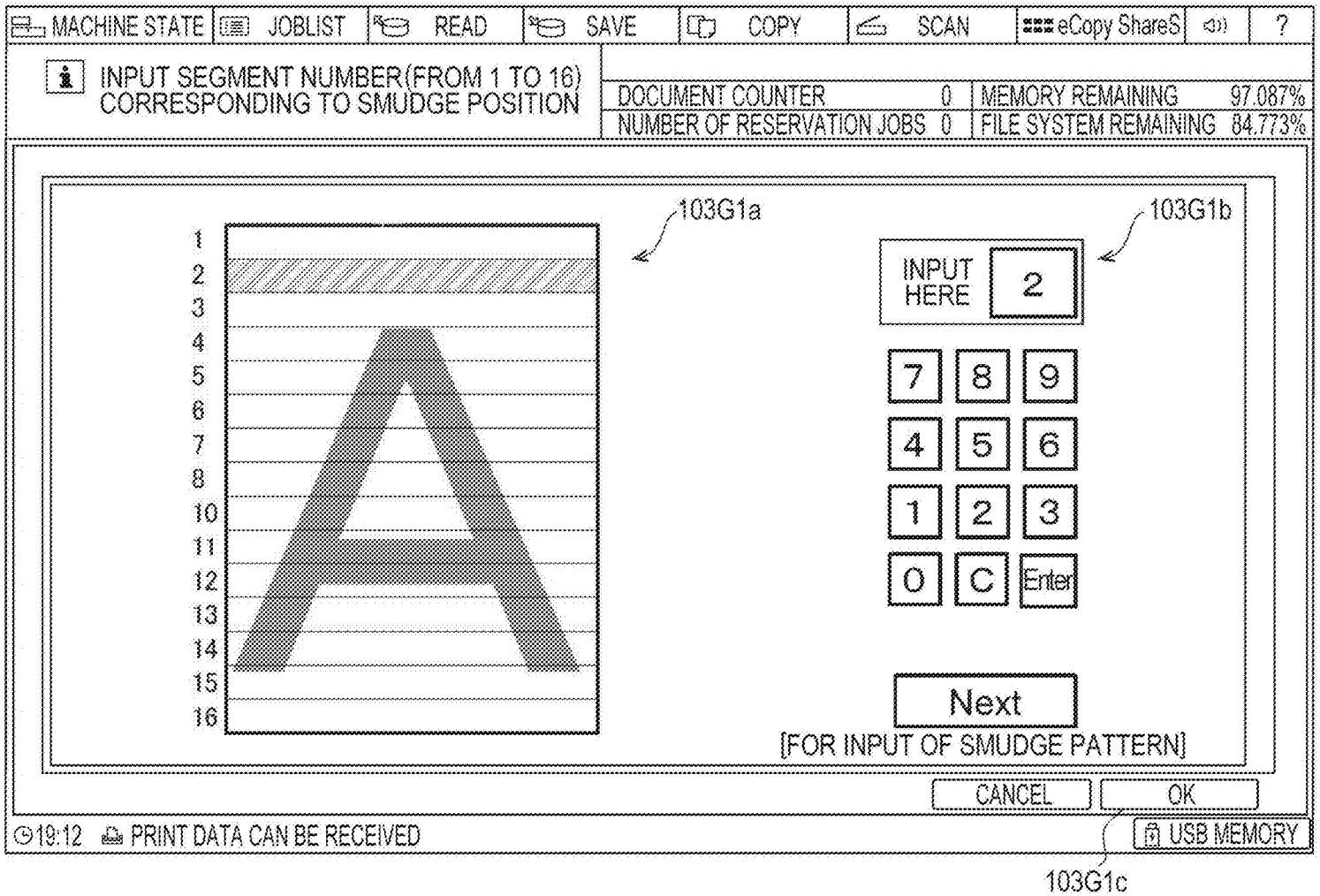
FIG. 4 is an explanatory diagram of a screen status of an image forming system in operation according to an embodiment of the present invention.

In order to enable the user to input the information on the smudge on the paper sheet, the controller 101 instructs the operation display unit 103 to display a smudge position input window 103G1 as shown in FIG. 4. The smudge position input window 103G1 includes a smudge position sample field 103G1*a* for showing a smudge position sample and a number input field 103G1*b* for enabling the user to input the segment number corresponding to the position of the smudge. The user can easily input the information on the position of the smudge on the paper sheet by inputting the segment number corresponding to the position of the smudge on the paper sheet through the smudge position input window 103G1 on the operation display unit 103. In FIG. 4, the segment of the number 2, which the user has input in the number input field 103G1*b*, is highlighted in the smudge position sample field 103G1*a* under the control of the controller 101. When the smudge is wide, the user can input a plurality of numbers corresponding to the segments covering the smudge (2 and 3, for example). When a plurality of smudges are found, the user can input a plurality of numbers corresponding to the segments covering the smudges (2 and 15, for example). The user can determine the information on the smudge by tapping an OK button 103G1*c*.

When the smudge has a pattern due to a roller tread pattern, the user can tap the [Next] button in the smudge position input window 103G1 to go to a smudge pattern input window 103G2 (FIG. 5) on the operation display unit 103 under the control of the controller 101.

The smudge pattern input window 103G2 includes a smudge pattern sample field 103G2*a* for showing a smudge pattern sample and a number input field 103G2*b* for enabling the user to input the number corresponding to the pattern of the smudge. The user can easily input the information on the pattern of the smudge on the paper sheet by inputting the number corresponding to the pattern of the smudge on the paper sheet through the smudge pattern input window 103G2 on the operation display unit 103. In FIG. 5, the pattern of the number 2, which the user has input in the number input field 103G2*b*, is highlighted in the smudge pattern sample field 103G2*a* under the control of the controller 101. The user can determine the information on the smudge by tapping an OK button 103G2*c*.

Figure 5:
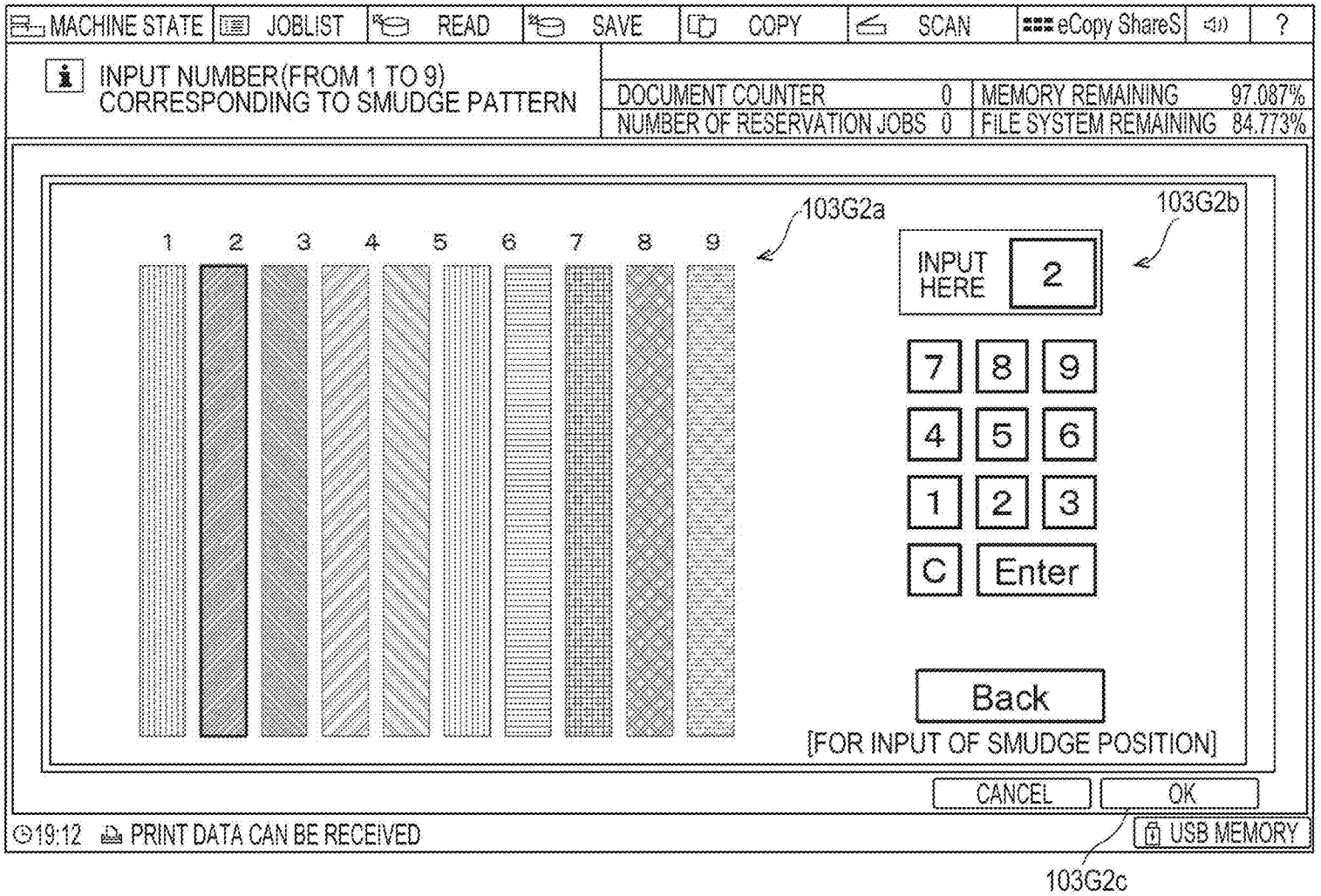
FIG. 5 is an explanatory diagram of a screen status of an image forming system in operation according to an embodiment of the present invention.
Figure 6:
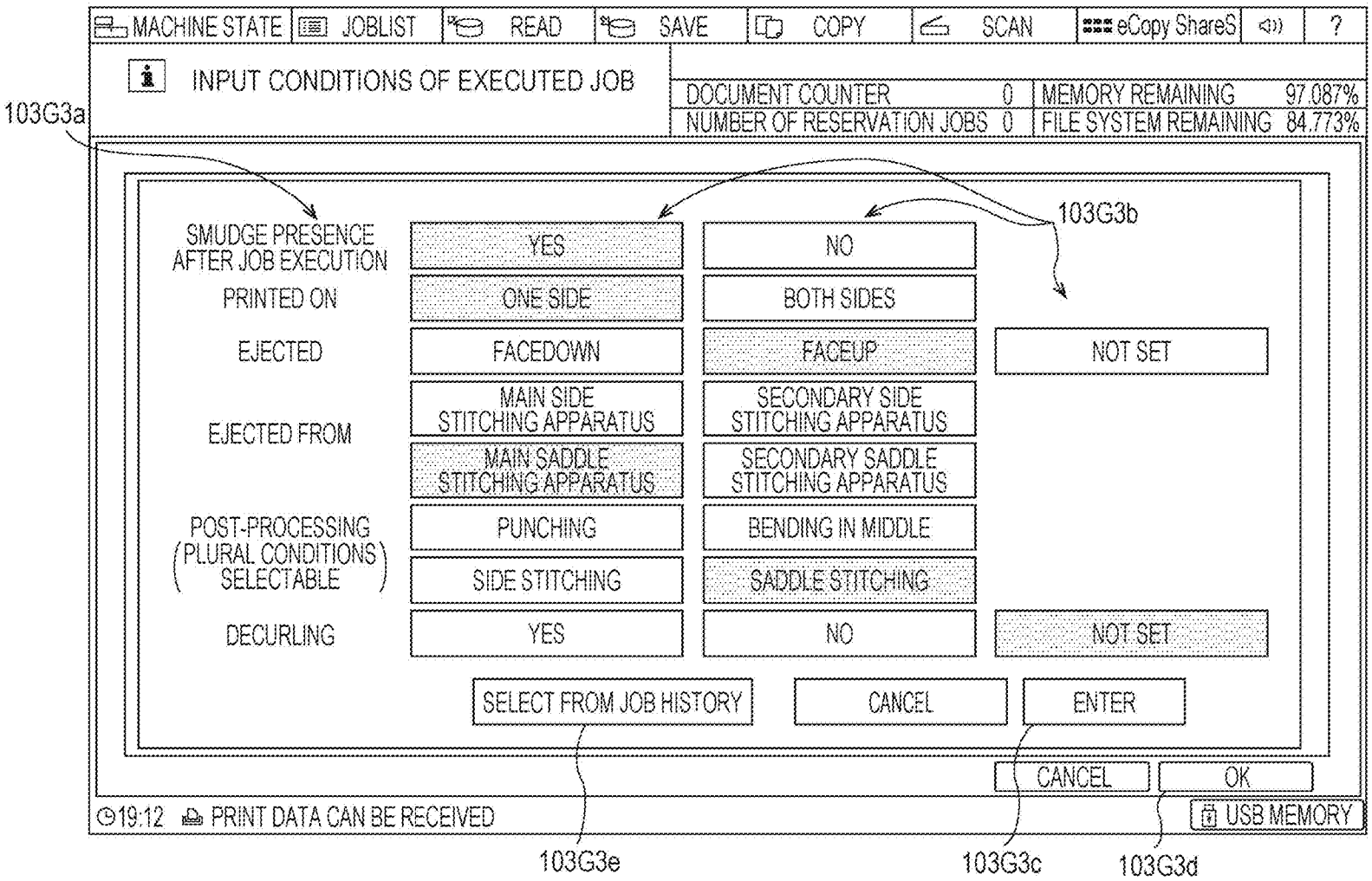
FIG. 6 is an explanatory diagram of a screen status of an image forming system in operation according to an embodiment of the present invention.

The controller 101 can acquire the information on the smudge on the paper sheet through the user's input of the information on the position and pattern of the smudge as shown in FIGS. 4 and 5. Other than that, the controller 101 can acquire the information on the smudge on the paper sheet (the information on the position of the smudge, the information on the width of the smudge, the information on the interval(s) between the smudges (when a plurality of smudges are found), and the information on the pattern of the smudge) by reading the paper sheet with the smudge at the reader 120.

The controller 101 then acquires information on an executed job (step S102 in FIG. 3). The information on an executed job is used for narrowing down potentially dirty rollers and includes information for identifying the conveyance paths that have conveyed a paper sheet in a certain job. In order to enable the user to input the information on the executed job, the controller 101 instructs the operation display unit 103 to display a job information input window 103G3 as shown in FIG. 6. The job information input window 103G3 includes an item field 103G3*a* for showing the items of an executed job and a condition input field 103G3*b* for enabling the user to input a condition for each item (make a choice among a few alternatives). The user can properly and easily input the information on the executed job necessary for narrowing down possibly dirty rollers by choosing from the alternatives through the job information input window 103G3 on the operation display unit 103.

In the example job information input window 103G3 in FIG. 6, the information on the executed job includes the items and the alternatives of the conditions as follows:

SMUDGE PRESENCE AFTER JOB EXECUTION: [YES/NO],

PRINTED ON: [ONE SIDE/BOTH SIDES],

EJECTED: [FACEDOWN/FACEUP/NOT SET],

EJECTED FROM: [MAIN SIDE STITCHING APPARATUS/SECONDARY SIDE STITCHING APPARATUS/MAIN SADDLE STITCHING APPARATUS/SECONDARY SADDLE STITCHING APPARATUS],

POST-PROCESSING: [PUNCHING/BENDING IN MIDDLE/SIDE STITCHING/SADDLE STITCHING], and DECURLING: [YES/NO/NOT SET]. In the item of POST-PROCESSING, a plurality of alternatives can be chosen from the conditions that have been set. In the job information input window 103G3, the user can chose at least one of the alternatives of the item of SMUDGE PRESENCE AFTER JOB EXECUTION, YES or NO and chose the alternatives of the other items based on the condition, YES or NO.

The user can determine the information on the executed job by tapping an enter button 103G3*c* and an OK button 103G3*d*. Other than the job information input window 103G3 as shown in FIG. 6, the user can use a job history select button 103G3*e* to input the information on the executed job with reference to the job history. The controller 101 can acquire the information on the executed job from these user's inputs.

The controller 101 may acquire the information on the executed job (step S102 in FIG. 3) later as necessary while narrowing down potentially dirty rollers as described below (from step S104 in FIG. 3).

After acquiring the information on the smudge as above, the controller 101 refers to the acquired information on the smudge and the information on the rollers to select the rollers that are disposed at the positions corresponding to that of the smudge on the paper sheet (step S103 in FIG. 3). The controller 101 selects all the suspect rollers at this stage before narrowing down the suspect rollers. The controller 101 selects the suspect rollers in the main scanning direction of the rollers (in the direction orthogonal to the paper conveying direction) at this stage. The controller 101 can thus select the suspect rollers at high speed under low load. The controller 101 may select possibly dirty rollers (step S103 in FIG. 3) right after the information on the position of the smudge is acquired.

Figure 7:
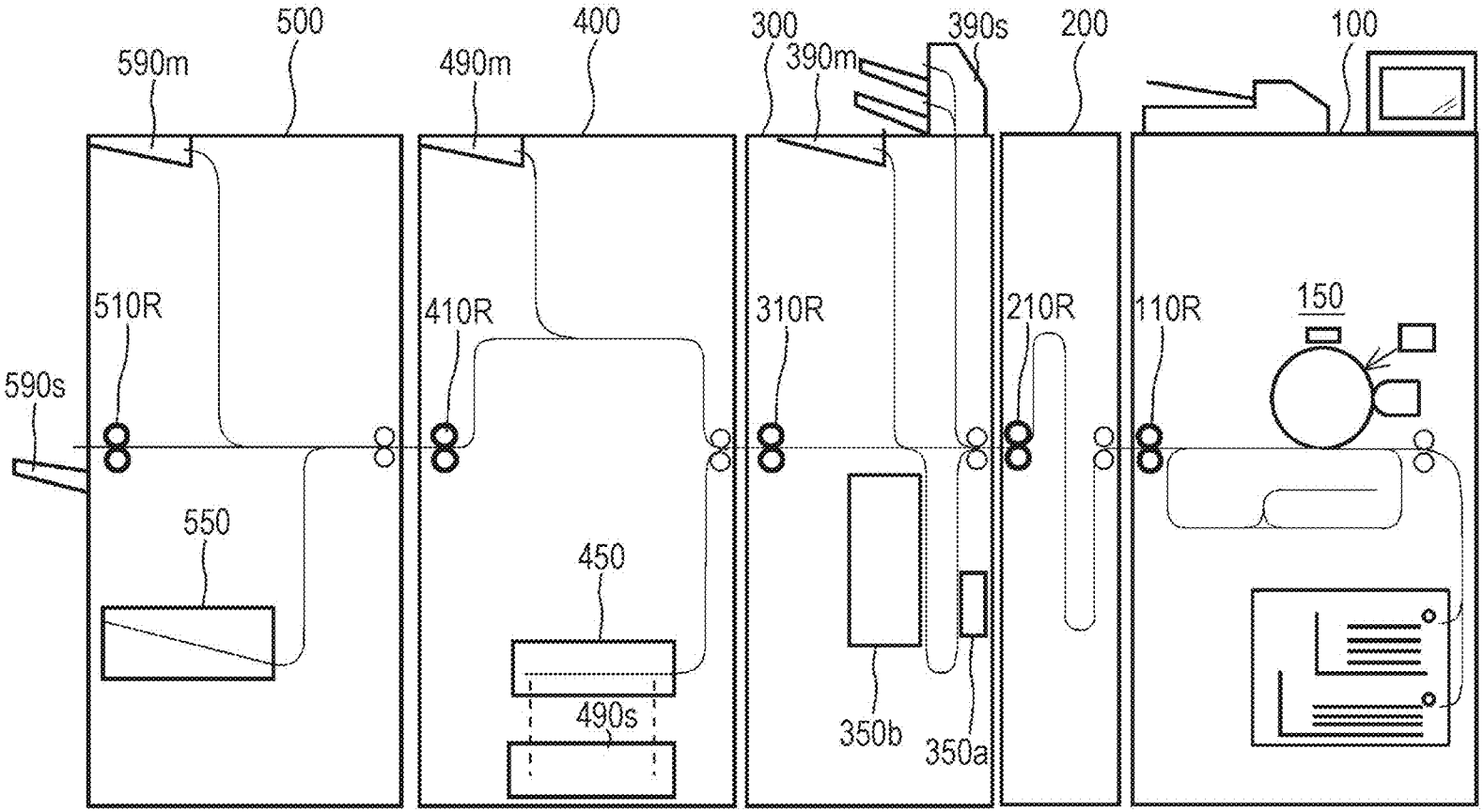
FIG. 7 is an explanatory diagram of an operational status of an image forming system according to an embodiment of the present invention.

FIG. 7 shows an example in which the rollers corresponding to the position of the smudge are selected (highlighted). In this example, a roller 110R at the end of the conveyance path in the image forming apparatus 100, a roller 210R at the end of the conveyance path in the post-processing apparatus 200, a roller 310R at the end of the conveyance path in the post-processing apparatus 300, a roller 410R at the end of the conveyance path in the post-processing apparatus 400, and a roller 510R at the end of the conveyance path in the post-processing apparatus 500 are selected.

Figure 8:
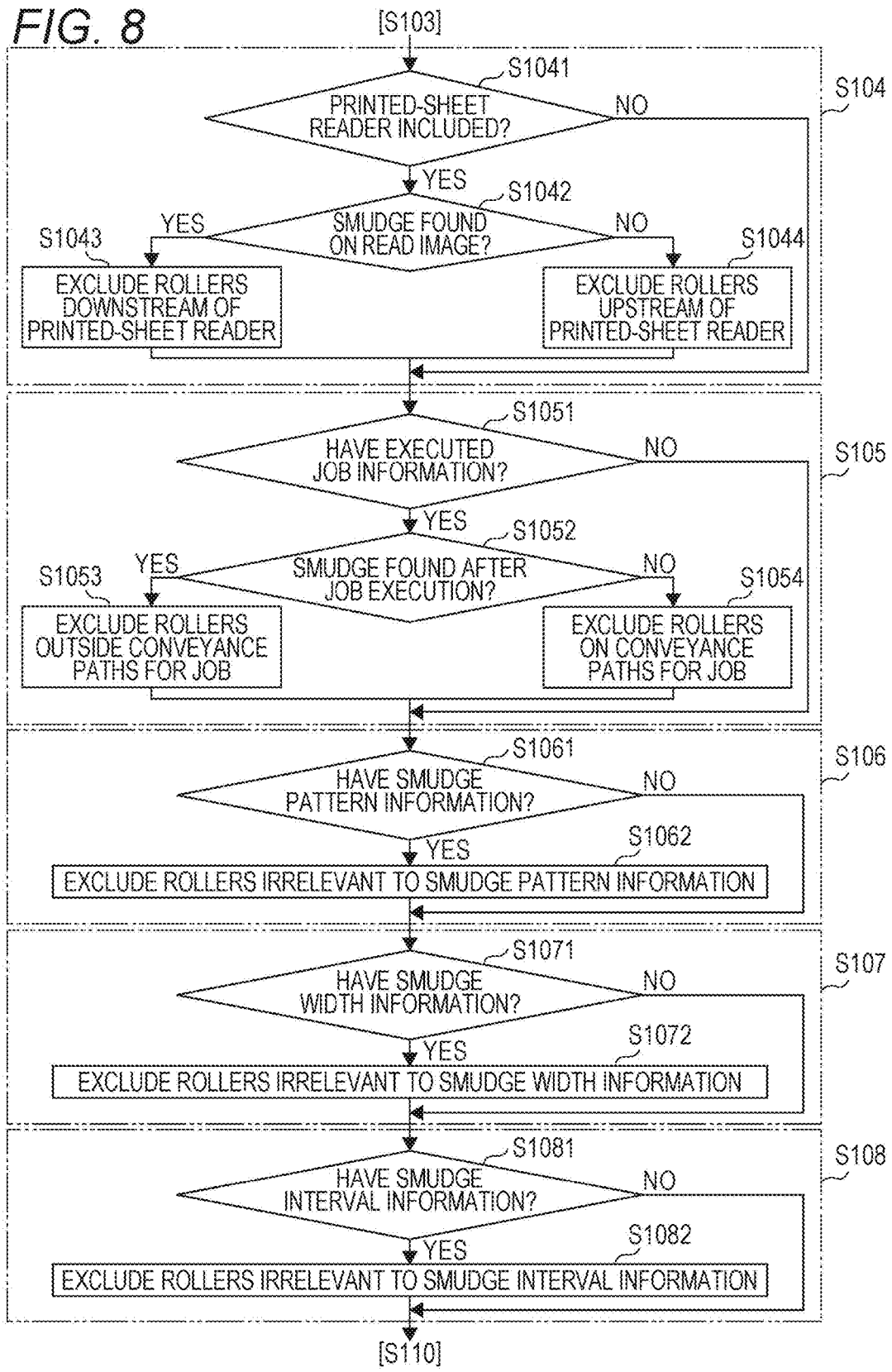
FIG. 8 is a flow chart of the operational steps for identifying a dirty roller or rollers according to an embodiment of the present invention.

With reference to the flow chart of FIG. 8 and the explanatory diagrams of FIGS. 9 to 12, the procedures which the controller 101 takes to narrow down the selected rollers will now described.

When any one of the post-processing apparatuses includes a printed-sheet reader, the controller 101 refers to the information on the position of the printed-sheet reader and its read results to narrow down the selected possibly dirty rollers (step S104 in FIG. 3).

Figure 9:
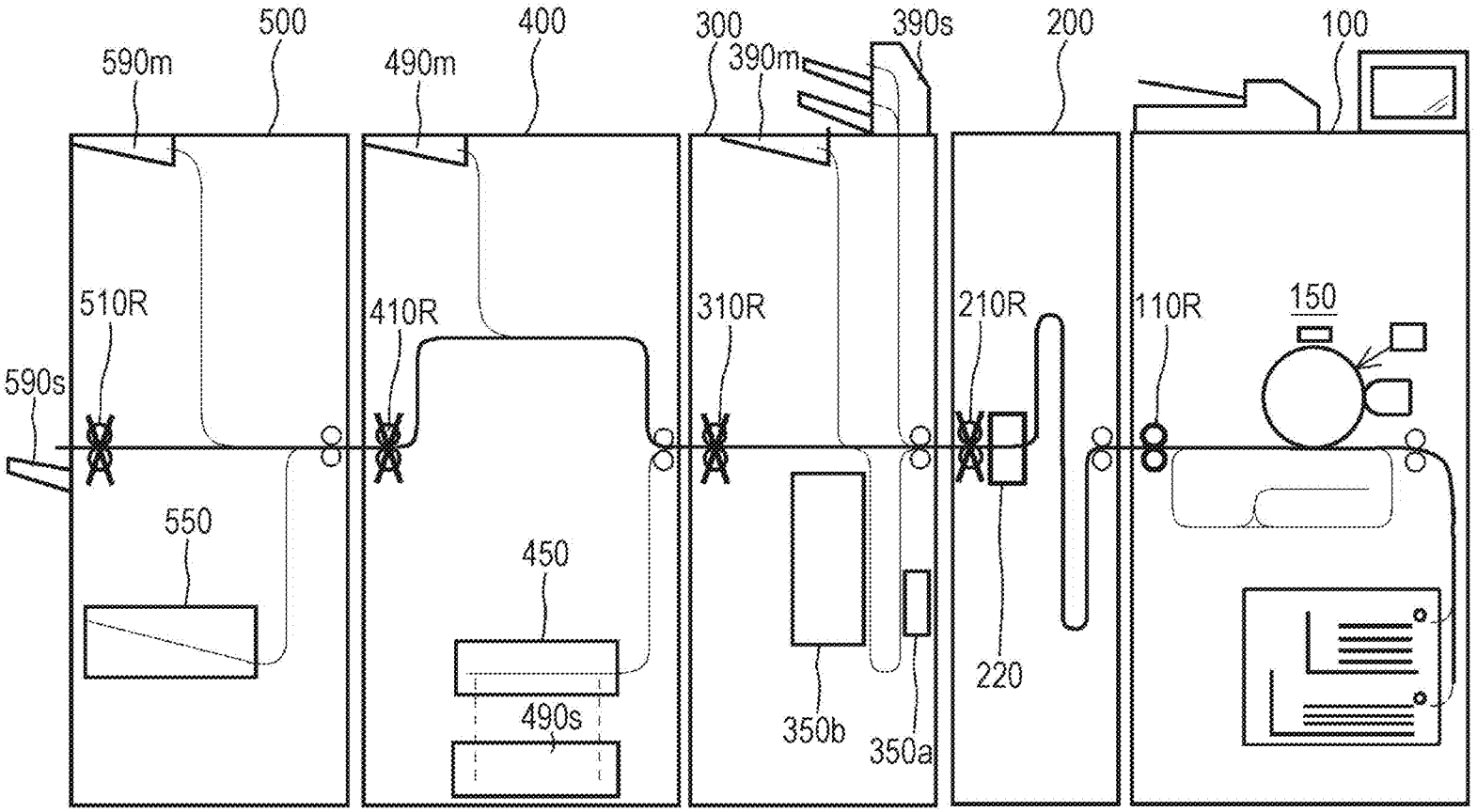
FIG. 9 is an explanatory diagram of an operational status of an image forming system according to an embodiment of the present invention.
Figure 10:
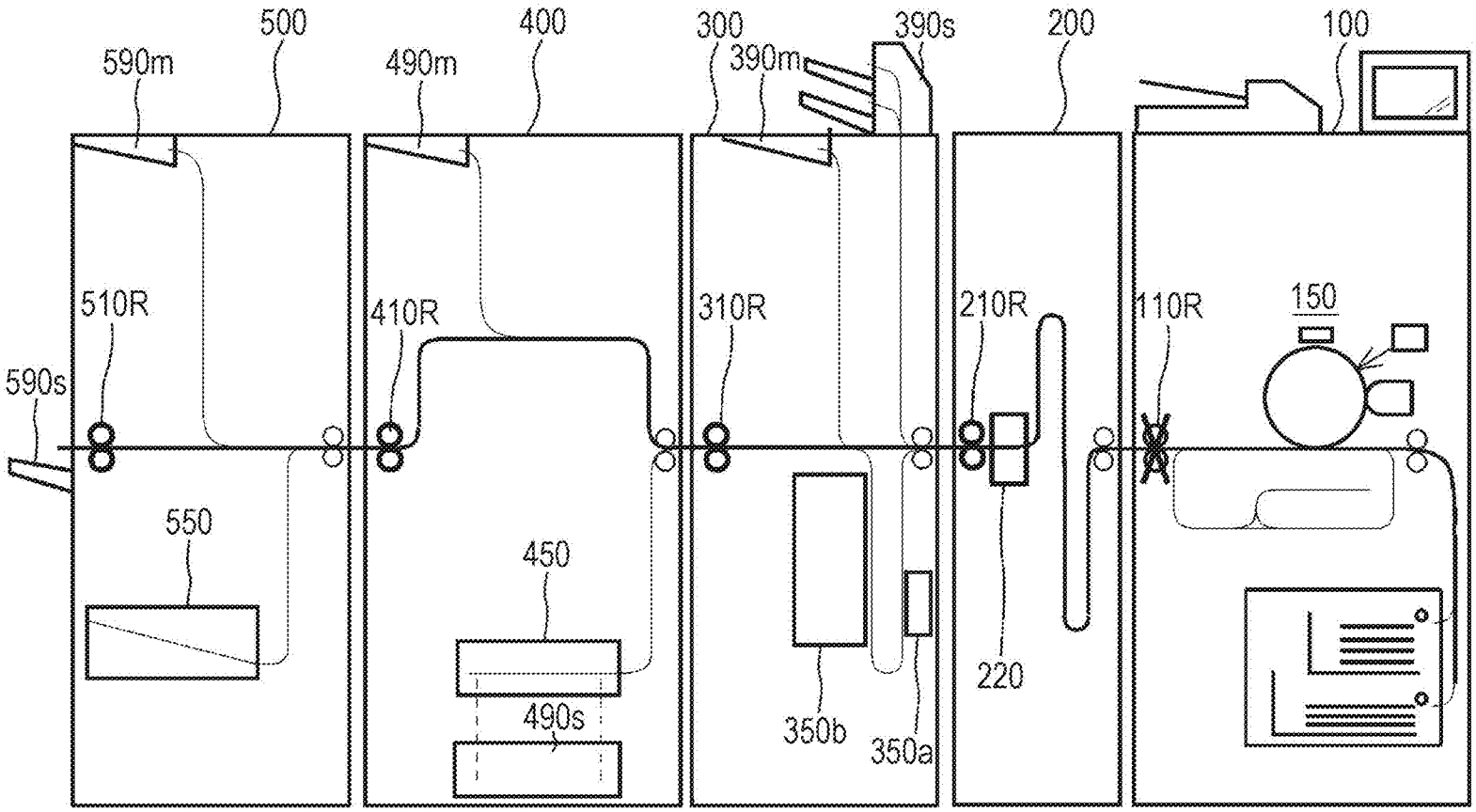
FIG. 10 is an explanatory diagram of an operational status of an image forming system according to an embodiment of the present invention.

As shown in FIGS. 9 and 10, for example, the post-processing apparatus 200 includes a printed-sheet reader 220 in the middle of the conveyance path. In other words, if any one of the post-processing apparatuses includes a printed-sheet reader (YES at step S1041 in FIG. 8) and if the printed-sheet reader reads an image with a smudge (YES at step S1042 in FIG. 8), the controller 101 excludes the rollers downstream of the printed-sheet reader 220 from the possibly dirty rollers (step S1043 in FIG. 8). FIG. 9 schematically shows the status in which the rollers downstream of the printed-sheet reader 220 (the rollers 210R, 310R, 410R, and 510R) are excluded from the possibly dirty rollers (shown by the X marks in FIG. 9).

If the printed-sheet reader reads an image with no smudge (NO at step S1042 in FIG. 8), the controller 101 excludes the rollers upstream of the printed-sheet reader 220 from the possibly dirty rollers (step S1044 in FIG. 8). FIG. 10 schematically shows the status in which the roller upstream of the printed-sheet reader 220 (the roller 110R) is excluded from the possibly dirty rollers (shown by the X mark in FIG. 10).

The exclusion with reference to the position of the printed-sheet reader 220 and its read results only requires simple parameters such as the presence of a smudge and the position of the printed-sheet reader 220. The controller 101 can thus narrow down the suspect rollers at high speed under low load. The early-stage exclusion can reduce the number of the suspect rollers at an early stage.

With reference to the information on the executed job, the controller 101 further narrows down the possibly dirty rollers by excluding the rollers outside the conveyance paths that have been used for the job causing the smudge on the paper sheet or the rollers on the conveyance paths that have been used for the job causing no smudge on a paper sheet (step S105 in FIG. 3). In other words, if the controller 101 has the information on an executed job (YES at step S1051 in FIG. 8) and if the job has caused a smudge on a paper sheet (YES at step S1052 in FIG. 8), the controller 101, based on the information on the executed job causing the smudge, excludes the rollers outside the conveyance paths that have conveyed the paper sheet in the job causing the smudge (step S1053 in FIG. 8). If the controller 101 has the information on an executed job (YES at step S1051 in FIG. 8) and if the job has caused no smudge on a paper sheet (NO at step S1052 in FIG. 8), the controller 101, based on the information on the executed job causing no smudge, excludes the rollers on the conveyance paths that have conveyed the paper sheet in the job causing no smudge (step S1054 in FIG. 8).

Figure 11:
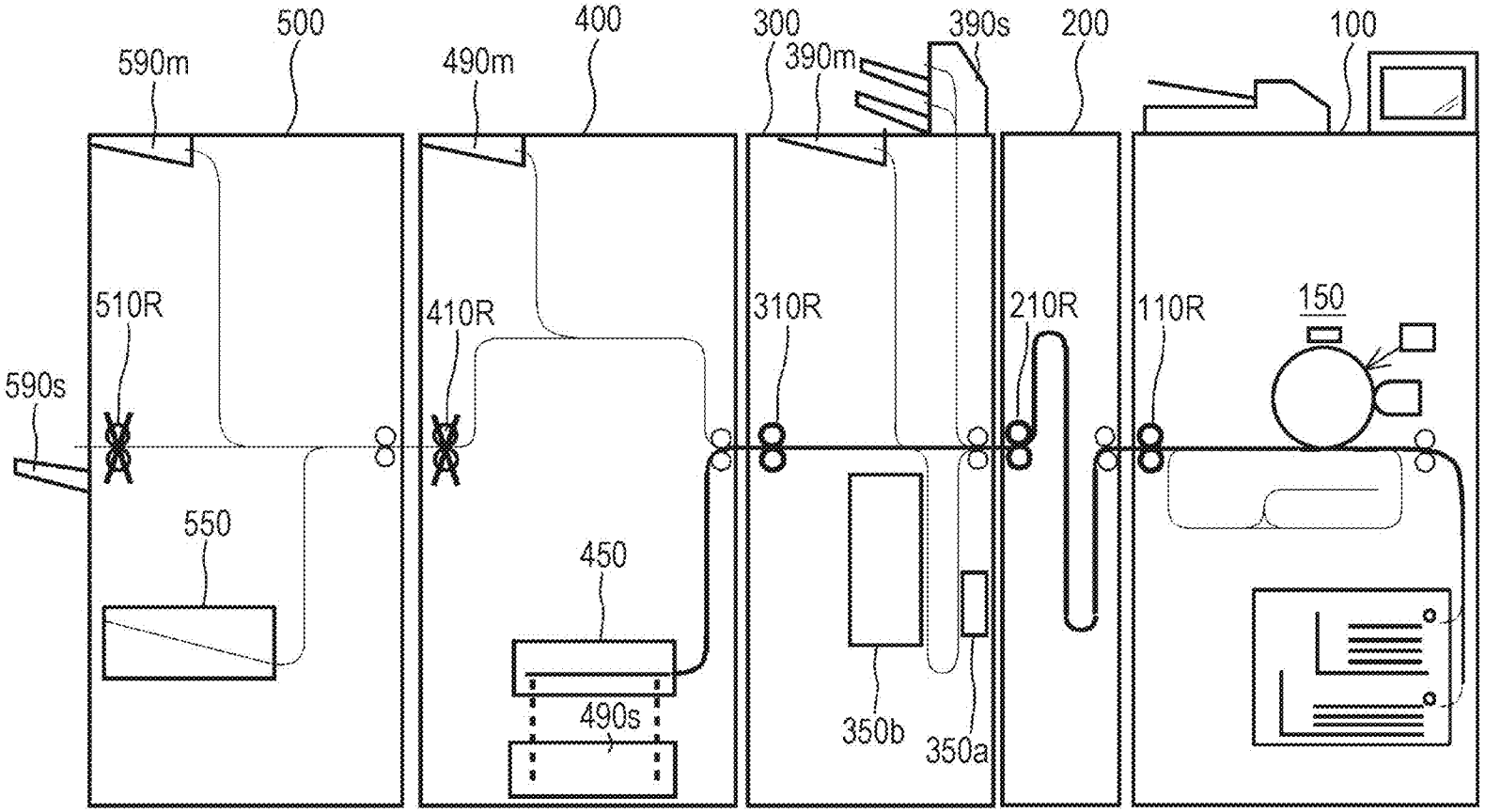
FIG. 11 is an explanatory diagram of an operational status of an image forming system according to an embodiment of the present invention.

As shown in FIG. 11, for example, there is a case where a smudge is found on a paper sheet after the job in which the paper sheet is fed from the paper feed unit, undergoes image formation by the image forming apparatus 100, passes through the post-processing apparatuses 200 and 300, and undergoes saddle stitching at the paper processing unit 450 and is ejected from the secondary ejection port 490*s* of the post-processing apparatus 400. In this case, the rollers 410R and 510R are outside the conveyance paths that have conveyed the paper sheet with the smudge (shown in thin lines in FIG. 11) and are thus excluded from the possibly dirty rollers (shown in the X marks in FIG. 11).

Figure 12:
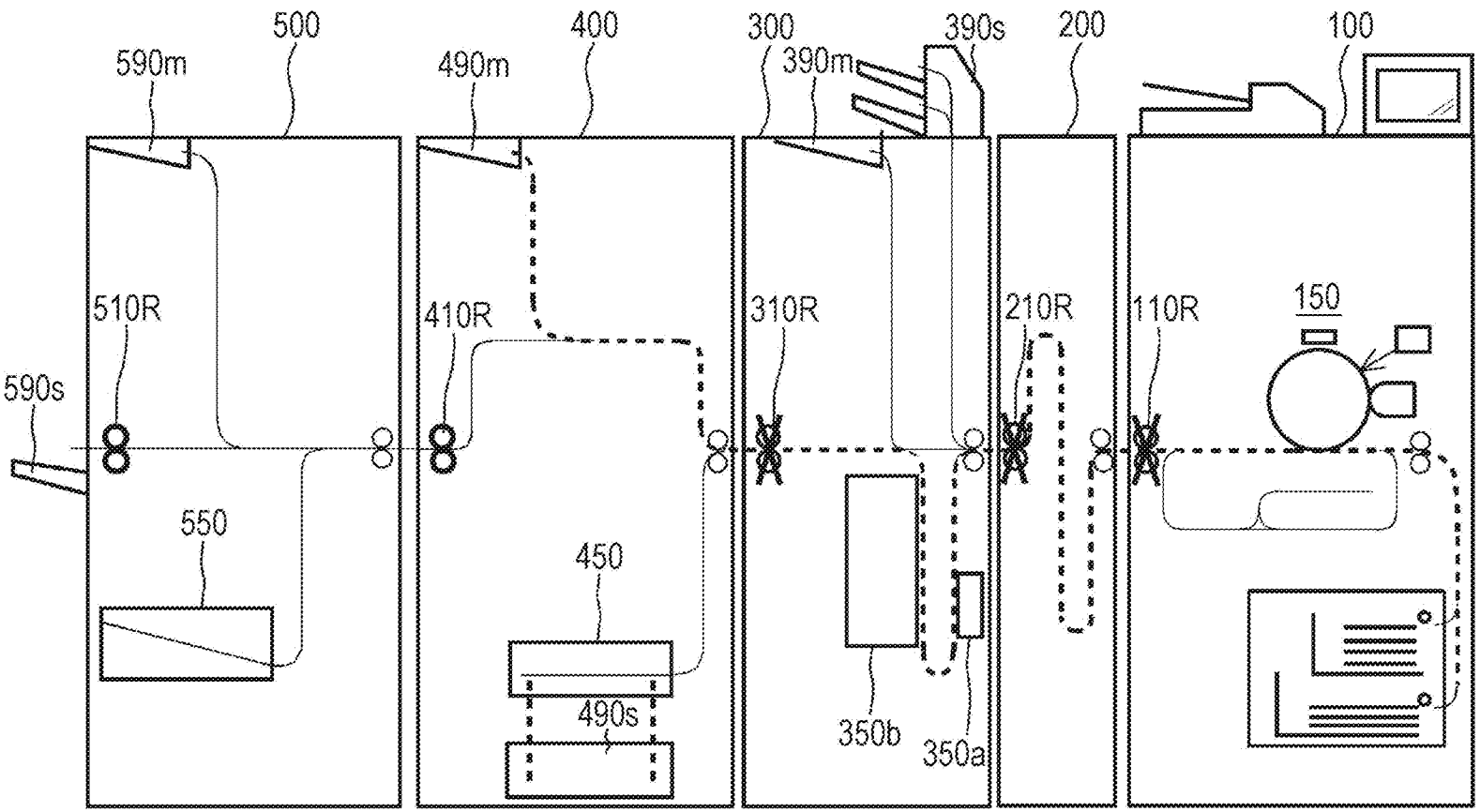
FIG. 12 is an explanatory diagram of an operational status of an image forming system according to an embodiment of the present invention.

As shown in FIG. 12, for example, there is a case where no smudge is found on a paper sheet after the job in which the paper sheet is fed from the paper feed unit, undergoes image formation by the image forming apparatus 100, passes through the post-processing apparatuses 200 and 300, and is ejected from the main ejection port 490*m* of the post-processing apparatus 400. In this case, the rollers 110R, 210R, and 310R are on the conveyance paths that have conveyed the paper sheet with no smudge (shown in bold dashed line in FIG. 12) and are thus excluded from the possibly dirty rollers (shown in the X marks in FIG. 12).

The exclusion of the rollers outside the conveyance paths conveying a sheet with a smudge or the rollers on the conveyance paths conveying a sheet with no smudge, which is surely performed, can surely narrow down the possibly dirty rollers. In addition, by repeatedly excluding the rollers irrelevant to the smudge with reference to information on different executed jobs, the possibly dirty rollers can surely be narrowed down.

The controller 101 also refers to the information on the smudge and the information on the rollers and compares the information on the pattern of the smudge with the information on the tread patterns of the rollers to exclude the rollers having the tread patterns irrelevant to the pattern of the smudge from the possibly dirty rollers (step S106 in FIG. 3). In other words, if the controller 101 has information on the pattern of a smudge (YES at step S1061 in FIG. 8), the controller 101 compares the information on the pattern of the smudge with the information on the tread patterns of the rollers to exclude the rollers having the tread patterns irrelevant to the pattern of the smudge and narrow down the possibly dirty rollers (step S1062 in FIG. 8).

When the exclusion by the comparison of the information on the pattern of a smudge with the information on the tread patterns of the rollers is performed to narrow down the possibly dirty rollers, a plurality of different tread patterns of the rollers help to narrow down the suspect rollers to the rollers having one specific tread pattern. The controller 101 can thus narrow down the suspect rollers at high speed under low load. In this embodiment, since a plurality of parameters are used for narrowing down the possibly dirty rollers, a few tread patterns of the rollers are enough and there is no need to have all the rollers provided with different tread patterns.

The controller 101 also refers to the information on the smudge and the information on the rollers and compares the information on the width of the smudge with the information on the widths of the rollers to exclude the rollers having the widths irrelevant to the width of the smudge from the possibly dirty rollers (step S107 in FIG. 3). In other words, if the controller 101 has information on the width of a smudge (YES at step S1071 in FIG. 8), the controller 101 compares the information on the width of the smudge with the information on the widths of the rollers to exclude the rollers having the widths irrelevant to the width of the smudge and narrow down the possibly dirty rollers (step S1072 in FIG. 8).

When the exclusion by the comparison of the information on the width of a smudge with the information on the widths of the rollers is performed to narrow down the possibly dirty rollers, a plurality of different widths of the rollers help to narrow down the suspect rollers to the rollers having one specific width. The controller 101 can thus narrow down the suspect rollers at high speed under low load. In this embodiment, since a plurality of parameters are used for narrowing down the possibly dirty rollers, a few widths of the rollers are enough and there is no need to have all the rollers provided with different width.

The controller 101 also refers to the information on the smudge and the information on the rollers and compares the information on the interval(s) between the smudges with the information on the intervals between the rollers (or the pairs of rollers) to exclude the rollers having the intervals irrelevant to the interval(s) between the smudges from the possibly dirty rollers (step S108 in FIG. 3). In other words, if the controller 101 has information on the interval(s) between smudges (YES at step S1081 in FIG. 8), the controller 101 compares the information on the interval(s) between the smudges with the information on the intervals between the rollers to exclude the rollers having the intervals irrelevant to the interval(s) between the smudges and narrow down the possibly dirty rollers (step S1082 in FIG. 8). As for the intervals between the pairs of rollers, the rollers need to be paired. Therefore, the intervals between the pairs of rollers are taken into consideration only when the information on the width of the smudge and the information on the widths of the rollers are acquired.

When the exclusion by the comparison of the information on the interval(s) between smudges with the information on the intervals between the pairs of rollers is performed to narrow down the possibly dirty rollers, a plurality of different intervals between the pairs of rollers help to narrow down the suspect pairs of rollers to the pairs of rollers having one specific interval. The controller 101 can thus narrow down the suspect rollers at high speed under low load. In this embodiment, since a plurality of parameters are used for narrowing down the possibly dirty rollers, a few intervals between the pairs of rollers are enough and there is no need to have all the pairs of rollers provided with different intervals as in the conventional example.

After the controller 101 refers to the information on the smudge to select some possibly dirty rollers, and refers to the information on the smudge and the information on the executed job to narrow down the possibly dirty rollers, the controller 101 determines whether a dirty roller or rollers is/are identified (step S109 in FIG. 3).

If there are still many possibly dirty rollers and the possibly dirty rollers are not narrowed down enough (NO (many suspect rollers) at step S109 in FIG. 3), the controller 101 instructs the operation display unit 103 to display the window for requiring the user to add information (step S110 in FIG. 3) and returns to step S100 to repeat the steps from S100 in FIG. 3. In this case, if there is any information on the smudge that the controller 101 does not have, the controller 101 may require the user to input the information. In addition, the controller 101 may acquire other information on the executed job from the job history to exclude the rollers outside the conveyance paths causing the smudge or the rollers on the conveyance paths causing no smudge.

If the possibly dirty rollers are narrowed down to one roller or a few rollers (YES (identified) at step S109 in FIG. 3), the controller 101 instructs the operation display unit 103 to show the identified dirty roller(s) and the way of cleaning the dirty roller(s) (step S111 in FIG. 3), and ends the procedures.

If there are still many possibly dirty rollers even after the narrowing-down, the controller 101 instructs the operation display unit 103 to first show the user the most upstream roller, which has higher possibility of coming into contact with unfixed toner.

If no dirty roller is identified through the selection and narrowing-down (NO (not identified) at step S109 in FIG. 3), the controller 101 instructs the operation display unit 103 to display the window for showing the result that no dirty roller is identified and requiring the user to call a service person as necessary (step S112 in FIG. 3), and ends the procedures.

As described above, in the image forming system according to an embodiment of the present invention, the controller 101 can properly select some possibly dirty rollers and narrow down the possibly dirty rollers to identify a dirty roller or rollers without increasing sensors or complicating conveyance control by setting different intervals between the rollers even in the image forming system 1 including many branched conveyance paths. In addition, since a plurality of parameters are used for the identification, the controller 101 can select and narrow down possibly dirty rollers to identify a dirty roller or rollers at high speed under low load even in the image forming system 1 including many rollers.

Although embodiments of the present invention have been described and illustrated in detail, it is clearly understood that the same is by way of illustration and example only and not limitation, the scope of the present invention should be interpreted by terms of the appended claims.

What is claimed is:

1. An image forming apparatus comprising:

an image formation part that forms an image on a paper sheet;

a conveyor that includes a plurality of conveying members and conveys the paper sheet;

an input unit receiving user indication of a smudge location on a paper sheet on which an image has been formed by the image formation part; and a hardware processor that acquires information on a smudge from the input unit pertaining to the user indication of the smudge location on the paper sheet on which an image has been formed by the image formation part, and identifies, from the plurality of conveying members, one or more dirty conveying members that may have caused the smudge based on at least one of the information on the smudge, information on the conveying members, and information on a job for image formation executed by the image formation part.

2. The image forming apparatus according to claim 1, wherein the information on the smudge includes at least one of information on a position of the smudge, information on a width of the smudge, information on a pattern of the smudge, and, if a plurality of smudges are found, information on one or more intervals between the smudges.

3. The image forming apparatus according to claim 1, wherein the information on the conveying members includes at least one of information on positions of the conveying members, information on widths of the conveying members, information on intervals between the conveying members, and information on tread patterns of the conveying members.

4. The image forming apparatus according to claim 1, wherein the information on the executed job includes information on whether the paper sheet is printed on one side or both sides, or information on whether the paper sheet is ejected facedown or faceup.

5. The image forming apparatus according to claim 1, wherein the image forming apparatus is connected to a post-processing apparatus that performs post-processing on a paper sheet on which an image has been formed by the image formation part, and the information on the executed job includes information on the post-processing.

6. The image forming apparatus according to claim 5, wherein the information on the executed job includes information on a type of the post-processing or information on where the paper sheet is ejected from.

7. The image forming apparatus according to claim 1, wherein the hardware processor compares the information on the smudge with the information on the conveying members to exclude the conveying members having the information irrelevant to the information on the smudge from possibly dirty conveying members for identifying the one or more dirty conveying members.

8. The image forming apparatus according to claim 1, wherein the hardware processor excludes the conveying members outside one or more conveyance paths that have been used for the job causing the smudge on the paper sheet or the conveying members on the one or more conveyance paths that have been used for a job causing no smudge on a paper sheet from the possibly dirty conveying members based on the information on different executed jobs to identify the one or more dirty conveying members.

9. The image forming apparatus according to claim 1, wherein the hardware processor selects some possibly dirty conveying members from all the conveying members based on the information on the smudge and narrows down the possibly dirty conveying members based on the information on the conveying members or the information on the executed job to identify the one or more dirty conveying members.

10. The image forming apparatus according to claim 1, further comprising a printed-sheet reader that reads the image on the paper sheet, wherein the hardware processor identifies the one or more dirty conveying members based on the information on the conveying members, information on a position of the smudge read by the printed-sheet reader, and information on the image on the paper sheet read by the printed-sheet reader.

11. The image forming apparatus according to claim 1, wherein the hardware processor identifies the one or more dirty conveying members based on the information on the smudge, the information on the conveying members, or information on the executed job.

12. The image forming apparatus according to claim 1, further comprising an operator that inputs information, wherein the information on the smudge is input through the operator.

13. The image forming apparatus according to claim 1, further comprising an operator that inputs information, wherein the information on the executed job is input through the operator.

14. The image forming apparatus according to claim 1, further comprising a reader that reads the image on the paper sheet, wherein the information on the smudge is input through the reader.

15. The image forming apparatus according to claim 1, wherein the hardware processor acquires the information on the executed job with reference to a history of the executed job.

16. The image forming apparatus according to claim 1, wherein the conveying members include rollers.

17. The image forming apparatus according to claim 1, wherein the smudge is in the form of a streak parallel to the paper conveying direction.

18. The image forming apparatus according to claim 1, further comprising a display that displays information, wherein the hardware processor instructs the display to show an identified dirty conveying member, or, if a plurality of dirty conveying members are identified, to first show the most upstream conveying member in the paper conveying direction.

19. A non-transitory recording medium storing a computer readable control program that controls an image forming apparatus including an image formation part that forms an image on a paper sheet, and a conveyor that includes a plurality of conveying members and conveys the paper sheet, the program causing the computer to perform:

acquiring information indicative of a user indication of a location of a smudge on a paper sheet on which an image has been formed by the image formation part; and identifying, from the plurality of conveying members, one or more dirty conveying members that may have caused the smudge based on at least one of the information on the smudge, information on the conveying members, and information on a job for image formation executed by the image formation part.

* * * * *